US006659310B1

(12) United States Patent
Wolpert

(10) Patent No.: US 6,659,310 B1
(45) Date of Patent: Dec. 9, 2003

(54) PRODUCT DISPENSING AND DRAINBACK FITTING

(75) Inventor: Christopher J. Wolpert, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 09/524,811

(22) Filed: Mar. 14, 2000

(51) Int. Cl.[7] ..... B67D 1/16
(52) U.S. Cl. ..... 222/109; 222/424; 222/571
(58) Field of Search ..... 222/108, 109, 222/424, 424.5, 571

(56) References Cited

U.S. PATENT DOCUMENTS

| | | | | |
|---|---|---|---|---|
| 2,601,039 A | | 6/1952 | Livingstone | |
| 2,851,196 A | | 9/1958 | Livingstone | |
| 3,208,650 A | | 9/1965 | La Ham | |
| 3,434,637 A | | 3/1969 | Marcel | |
| 4,550,862 A | | 11/1985 | Barker et al. | |
| 5,108,009 A | | 4/1992 | Davidson et al. | |
| 5,147,076 A | | 9/1992 | Zanotelli | |
| 5,188,249 A | | 2/1993 | Cargile | |
| 5,207,356 A | * | 5/1993 | Krall | 222/109 |
| 5,566,862 A | * | 10/1996 | Haffner et al. | 222/109 |
| 5,855,299 A | * | 1/1999 | Arnold et al. | 222/109 |

FOREIGN PATENT DOCUMENTS

| | | | |
|---|---|---|---|
| ZA | 8803037 | * 11/1988 | 222/109 |

* cited by examiner

*Primary Examiner*—Kevin Shaver
*Assistant Examiner*—S L Willatt
(74) *Attorney, Agent, or Firm*—Parsons & Goltry; Michael W. Goltry; Robert A. Parsons

(57) ABSTRACT

A product dispensing and drainback fitting, for directing the flow of a liquid product from a container and minimizing the occurrence of double pour, having an outer wall for engagement with the neck of said container; an inner spout centrically positioned within said outer wall, a base extending between said wall and said spout and creating a circumscribing well, a longitudinal slot formed in said inner spout, said longitudinal slot beginning at a point about 30 mm to about 48 mm above said base and extending the remainder of the length of said spout; and drainback hole formed in said base and aligned with said longitudinal slot, said drainback hole having an area of about 10 $mm^2$ to about 20 $mm^2$.

5 Claims, 4 Drawing Sheets

FIG. 3
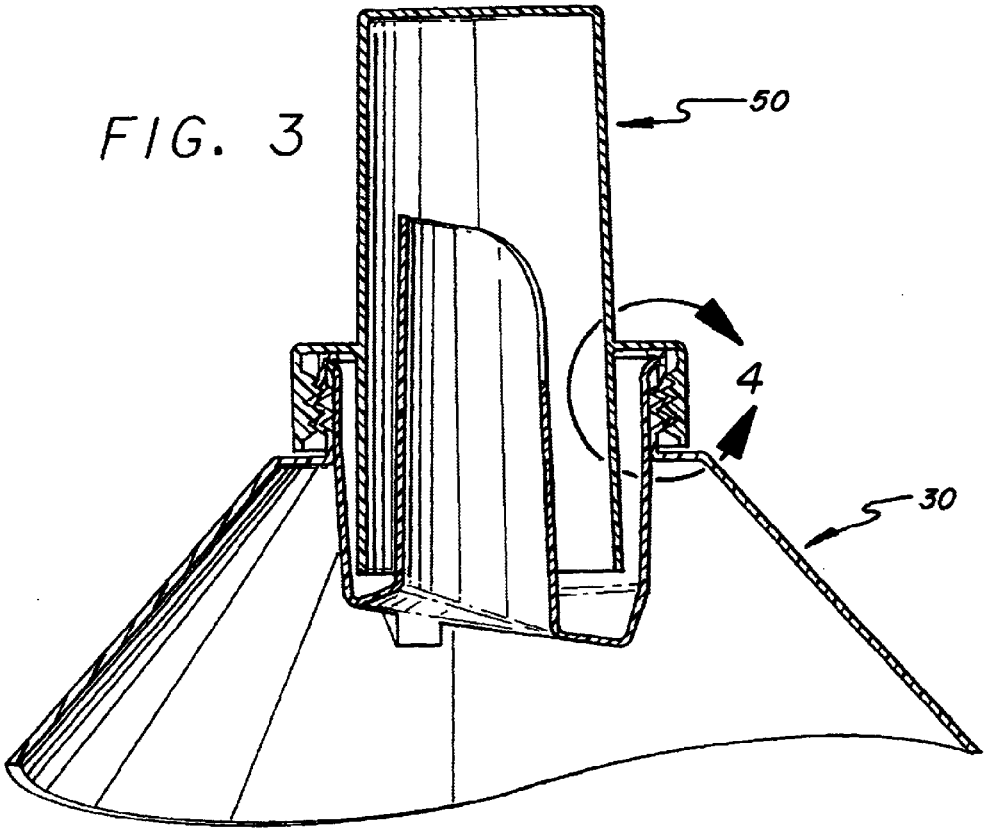
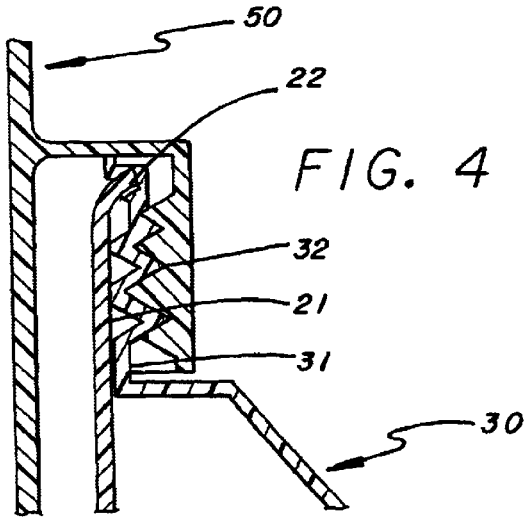
FIG. 4

PRODUCT DISPENSING AND DRAINBACK FITTING

This invention relates to a product dispensing and drainback fitting which is designed to be incorporated into the neck of a container for storing and pouring liquid.

BACKGROUND OF THE INVENTION

Many liquid containers have a pour spout incorporated into the neck of the container for dispensing a liquid product. Many of these containers also have a cap or closing device which also serves as a measuring cup. When the cap is used to close the container after being used to measure liquid, it is desirable to provide means for the liquid to drain from the interior of the cap into the container. It is also desirable to provide means for returning any liquid which flows onto the outside of the pour spout to the container. Various devices for incorporating liquid drainback features into the pour spouts of liquid containers have been considered. For example, U.S. Pat. No. 3,434,637 to Marcel and U.S. Pat. No. 5,108,009 to Davidson et al. both teach product dispensing and drainback fittings. In these patents, an inner pouring spout is surrounded by a circumscribing well which connects to the neck of the container. Commonly, these patents show pour spouts with a slot running from the pouring end to the base of the spout. The open slots taught by these patents serve to allow air to enter the container as liquid is poured from the container, which in turn allows the fluid to be poured with a faster, relatively even flow. Pour spouts with open slots as taught by these patents are in common use.

Until recently, the equipment used to fill containers with liquid has lacked some precision. As a result, manufacturers tended to set the container fill level on the low side in order to avoid overfilling the container. When the fill level of a container was kept on the low side, the open slots running from the pouring end to the base of the spout commonly used in the industry presented few problems. However, new improvements in the equipment used to fill containers with liquid have resulted in the ability to fill containers to a more exact predetermined level. Consequently, containers now have a consistently higher fill level. Although the higher fill level is beneficial to consumers, it has created some problems with using the prior art pour spouts with the circumscribing wells. When a user tips a container with a high fill level to pour liquid from the container, the liquid fills the entire area of the pour spout. When the pour spout is provided with a slot running substantially the entire length of the spout, some of the liquid being poured has a tendency to flow from the slot and into the well surrounding the spout. Due to the tilt of the container, once the liquid is in the well, it can drip out of the container. Liquid may also flow into the well from the drainback hole commonly located in base of the well in spouts of this type. As a result, a mess is created and product is wasted. This condition is called "double pour".

Various changes in the pour spout have been considered in an effort to avoid the double pour problem. One possible change is to widen the pour spout so that it can accommodate a greater volume of liquid. Unfortunately, if the pour spout is widened, the user's ability to control the direction of liquid flow is decreased. This is especially serious when the user wishes to measure the liquid because the user has difficulty directing the flow of liquid into the measuring cup. A wider pour spout also causes problems when using the pour spout as a spot stain treater to dispense a controlled amount of liquid to a particular area. The product dispensing and drainback fitting of the present invention solves the problem of double pouring while at the same time maintaining the ability to effectively aim the flow of liquid.

SUMMARY OF THE INVENTION

The product dispensing and drainback fitting of the present invention comprises a pour spout to facilitate directed pouring of the liquid, the spout being surrounded by a circumscribing well and having a shortened slot running from the pouring end of the spout towards the well with an appropriately sized drainback hole in the base of the well sized to prevent double pour.

BRIEF DESCRIPTION OF THE DRAWINGS

FIG. 3 is a sectional view showing the product dispensing and drainback fitting of the present invention mounted into the neck of a container.

FIG. 4 is an enlarged view of portion 4 of the product dispensing and drainback fitting shown in FIG. 3.

DETAILED DESCRIPTION OF THE DRAWINGS

Figure 1:
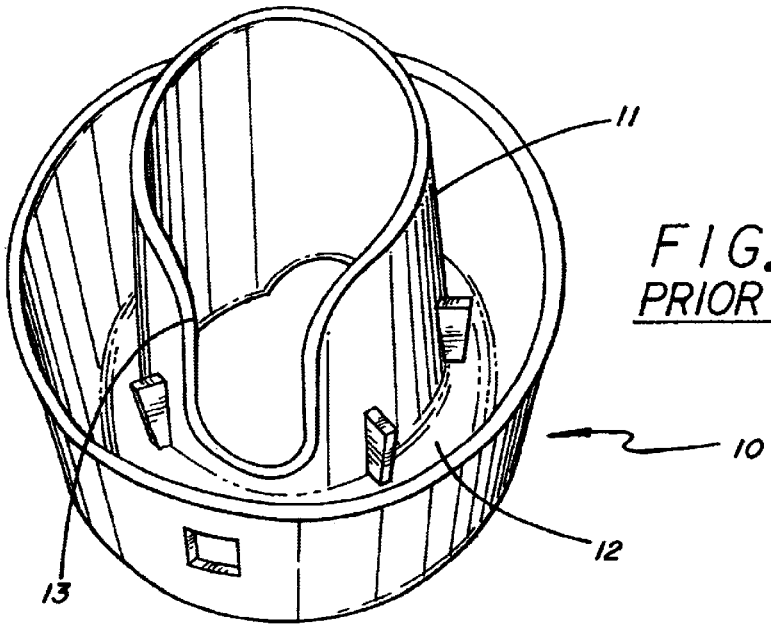
FIG. 1 PRIOR ART
FIG. 1 is a perspective view of a product dispensing and drainback fitting taught by the prior art.

The present invention generally discloses a uniquely designed product dispensing and drainback fitting which minimizes the double pour problem. FIG. 1 shows a conventional product dispensing and drainback fitting 10 having pour spout 11 and circumscribing well 12. As stated earlier, conventional fitting 10 has a slot 13 which runs substantially the entire length of pour spout 11. The disadvantage of fitting 10 is evident when a user attempts to pour liquid from a container having a high fill level. When a user tips a container with a high fill level to pour liquid from the container, the liquid fills the entire interior volume of pour spout 11. Because pour spout 11 has a slot 13 running substantially the entire length of the spout, some of the liquid being poured flows has a tendency to flow from slot 13 and into the well 12 surrounding spout 11. Due to the tilt of the container, once the liquid is in well 12, it will drip out of the container. Liquid may also flow into the well from the drainback hole (not shown) commonly located in base of the well in conventional fittings.

Figure 2:
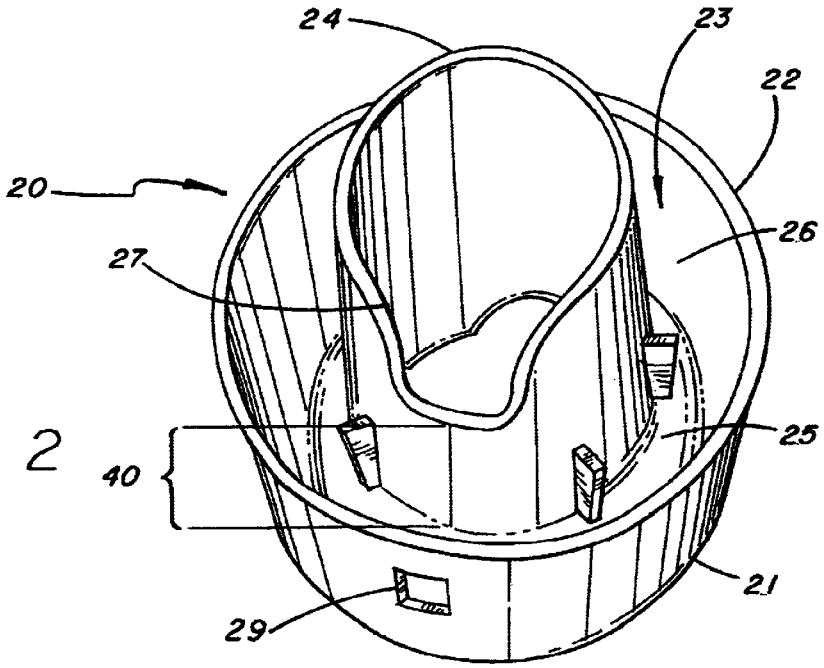
FIG. 2 is a perspective view of the product dispensing and drainback fitting of the present invention.
Figure 7:
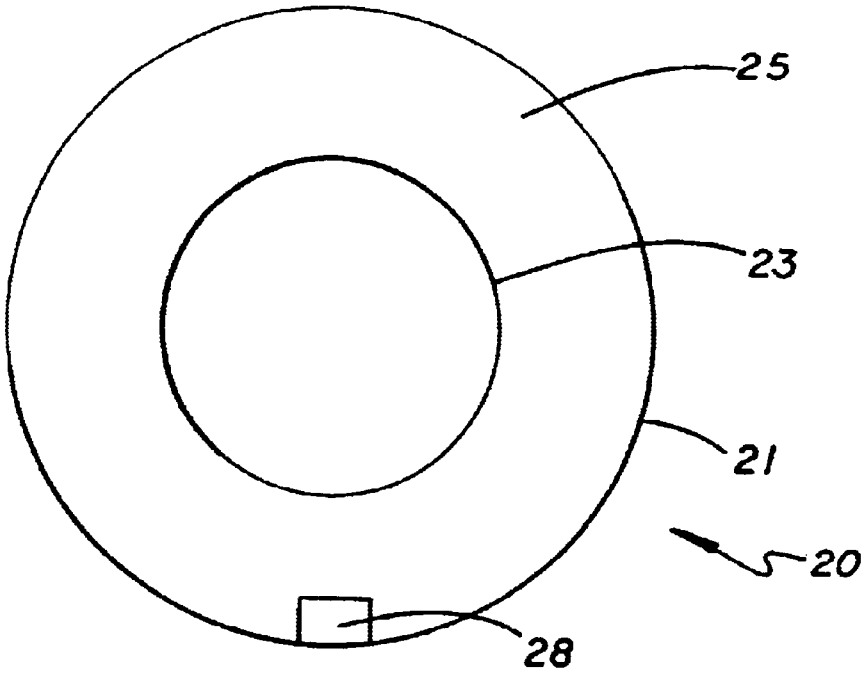
FIG. 7 is a top view of the product dispensing and drainback fitting of the present invention.

FIG. 2 shows a product dispensing and drainback fitting 20 of the present invention. Fitting 20 includes outer frustoconical wall portion 21, which gradually tapers downwardly and inwardly and is received within the neck of a bottle. Wall portion 21 terminates at its upper end with annular flange 22. Pour spout 23 is centrically positioned within wall portion 21. Spout 23 is also frustoconical in shape with a gradual taper toward pouring end 24. Base 25 extends between spout 23 and wall portion 21 creating a circumscribing well 26. Shortened longitudinal slot 27 is formed in spout 23 and is continuous with pouring end 24. As shown in FIG. 7, drainback hole 28 is provided in base 25 and positioned so that it is aligned with longitudinal slot 27.

As shown in FIG. 2, pour spout 23 is provided with shortened longitudinal slot 27, which extends a distance from pouring end 24 of spout 23. Applicant has discovered that the length of slot 27 is critical to preventing double pour. In conventional fitting 10, slot 13 extends substantially the entire length of spout 11. Consequently, when a container with a high fill level is tipped to dispense liquid, the liquid flows from slot 13 into well 12, then from the well out of the container. Applicant has found that by shortening the length of slot 27 and decreasing the area of drainback hole 28, double pouring is minimized.

Conventional drainback holes typically have an area of about 25 $mm^2$. Double pour can occur when a liquid flows through the drainback hole, into the well, and then out of the container. If the drainback hole is too large, liquid flows through the drainback hole too fast, filling the well and causing double pour regardless of the slot length.

In order to minimize the occurrence of double pour caused by liquid flow through the drainback hole, Applicant has discovered that it is desirable to limit the area of the drainback hole 28. However, the drainback hole must not be so small as to prevent the flow of liquid from the well, through the drainback hole and into the container. Applicant has discovered that for liquid products with a viscosity typical of most liquid detergents, a drainback hole with an area of from about 10 $mm^2$ to about 20 $mm^2$ in combination with a shortened slot length will minimize double pour and allow the liquid present in the well to drain back into the container. In the most preferred embodiment of the invention, drainback hole 28 has an area of about 15 $mm^2$.

The present invention is intended to function with a product dispensing and drainback fitting having a pour spout 23 of with a height of about 49 mm to 59 mm up from base 25. However, the invention will function with pour spouts with a height up to about 109 mm. Although there is no minimum height for pour spout 23, the pour spout should extend beyond outer wall portion 21 so that a liquid can be poured through the spout and into a measuring cup or onto a stain.

As shown in FIG. 2, numeral 40 represents the distance between base 25 and slot 13. According to the present invention, where drainback hole 28 is reduced to an area of about 20 $mm^2$, double pour is minimized by extending distance 40 such that it is about 35 to 48 mm. Where the drainback hole 28 is reduced to an area of about 15 $mm^2$, double pour is minimized by extending distance 40 such that it is about 30 to 48 mm. Where drainback hole 28 is even further reduced to an area of about 10 $mm^2$, double pour is minimized by extending distance 40 such that it is also about 30 to 48 mm. In Applicant's preferred embodiment drainback hole 28 has an area of about 15 $mm^2$ and distance 40 is about 35 mm.

As in conventional fitting 10, the product dispensing and drainback fitting 20 of the present invention is provided with side hole 29. Side hole 29 allows product which would otherwise be trapped between wall 21 and the container to be poured from the container.

As shown in FIGS. 3 and 4, the product dispensing and drainback fitting of the present invention is sized so as to be frictionally held within neck 31 of container 30. Annular flange 22 and wall 21 engage with neck 31 so as to form a gasket which seals the container. Fitting should be sized so that it is firmly held within the inner diameter of neck 31 and so that liquid cannot escape by flowing between wall 21 and container 30. Threads 32 are provided on the outer surface of neck 31 for engagement with cap 40, which seals the container. Cap 40 is preferably provided with liquid measurement indicators to facilitate appropriate dispensing of the liquid held by container 30.

Figure 5:
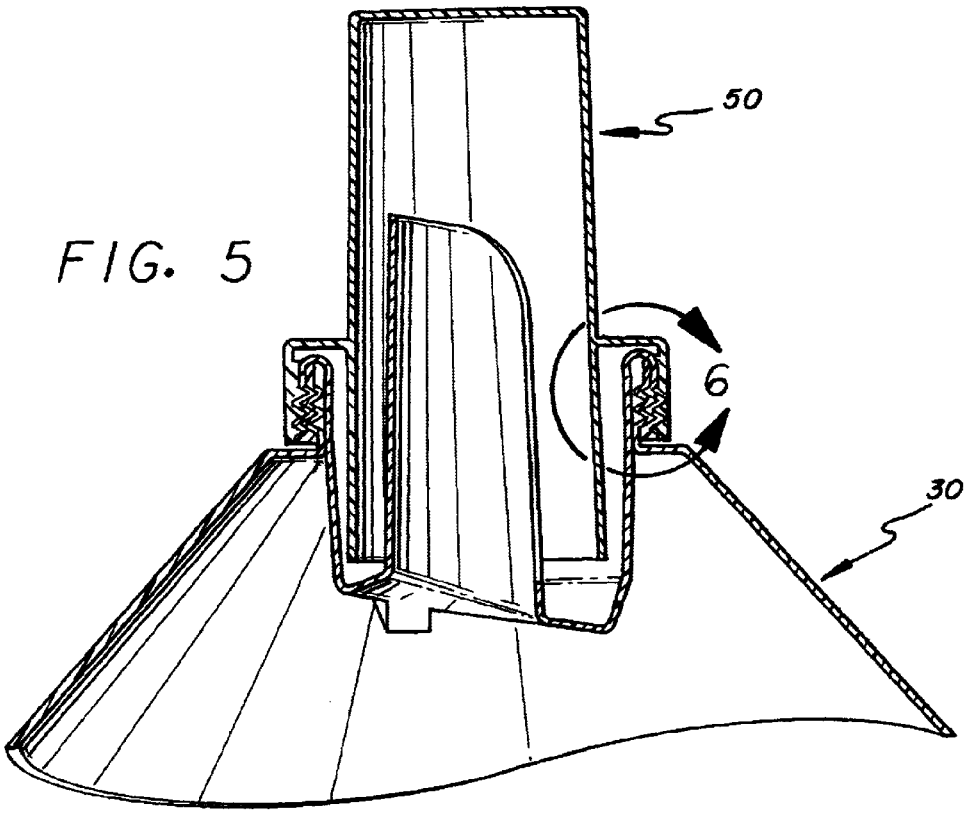
FIG. 5 is a sectional view showing an alternative embodiment of the product dispensing and drainback fitting of the present invention mounted into the neck of a container.
Figure 6:
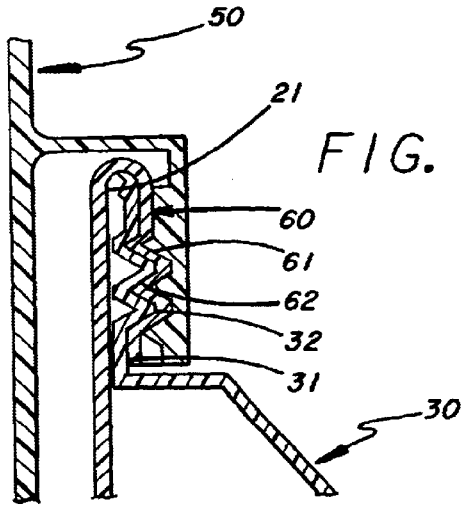
FIG. 6 is an enlarged view of portion 6 of the product dispensing and drainback fitting shown in FIG. 5.

In an alternate embodiment shown in FIGS. 5 and 6, fitting wall 21 is adapted to threadedly engage with threads 32 on neck 31. In this embodiment of the invention, wall 21 is continuous with a lip 60 which extends over neck 31 of container 30. The interior surface of lip 60 is provided with threads 61 adapted for engagement with threads 32 of neck 31. The exterior surface of lip 60 is provided with threads 62 adapted for engagement with cap 40.

I claim:

1. A product dispensing and drainback fitting for directing the flow of a liquid product from a container and minimizing the occurrence of double pour, said fitting comprising:

(a) an outer wall for engagement with the neck of said container;

(b) an inner spout centrically positioned within said outer wall;

(c) a base extending between said wall and said spout and creating a circumscribing well;

(d) a longitudinal slot formed in said inner spout, said longitudinal slot beginning at a point about 30 mm to about 48 mm above said base and extending the remainder of the length of said spout; and (e) a drainback hole formed in said base and aligned with said longitudinal slot, said drainback hole having an area of about 10 $mm^2$ to about 20 $mm^2$.

2. The product dispensing and drainback fitting of claim 1 wherein said longitudinal slot begins at a point about 35 to 48 mm above said base, and said drainback hole has an area of about 20 $mm^2$.

3. The product dispensing and drainback fitting of claim 1 wherein said longitudinal slot begins at a point about 30 to 48 mm above said base, and said drainback hole has an area of about 15 $mm^2$.

4. The product dispensing and drainback fitting of claim 1 wherein said longitudinal slot begins at a point about 30 to 48 mm above said base, and said drainback hole has an area of about 10 $mm^2$.

5. The product dispensing and drainback fitting of claim 1 wherein said longitudinal slot begins at a point about 35 mm above said base, and said drainback hole has an area of about 15 $mm^2$.

* * * * *